United States Patent [19]

Davies et al.

[11] 4,114,355

[45] Sep. 19, 1978

[54] APPARATUS FOR THE PRODUCTION OF WRAPPERS

[75] Inventors: Robert William Davies; Barry George Applegate, both of London, England

[73] Assignee: Molins Limited, London, England

[21] Appl. No.: 766,153

[22] Filed: Feb. 7, 1977

[30] Foreign Application Priority Data

Feb. 5, 1976 [GB] United Kingdom ..... 4480/76

[51] Int. Cl.[2] ..... B65B 41/06; B65B 41/16; B26D 7/06

[52] U.S. Cl. ..... 53/389; 83/88; 83/152; 83/303

[58] Field of Search ..... 53/389; 83/88, 112, 83/152, 303, 349

[56] References Cited

U.S. PATENT DOCUMENTS

| | | | |
|---|---|---|---|
| 2,100,930 | 11/1937 | Aiken | 83/349 X |
| 2,670,796 | 3/1954 | Orr | 83/303 |
| 3,847,046 | 11/1974 | Schmermund | 83/152 |
| 3,871,257 | 3/1975 | Schmermund | 83/303 X |
| 3,982,375 | 9/1976 | Focke | 53/389 X |

*Primary Examiner*—Robert Louis Spruill
*Attorney, Agent, or Firm*—John C. Smith, Jr.

[57] ABSTRACT

In apparatus for producing two-piece foil wrappers for wrapping bundles of cigarettes, a web of foil is cut alternately by two cylindrical cutters operating against fixed blades. A suction roller receives each successive newly cut end of the foil before the next cutter operates. Each resulting pair of foil wrapper pieces is then transferred to a suction drum having a sector arcuately movable thereon to produce an overlap in the wrapper pieces.

10 Claims, 4 Drawing Figures

APPARATUS FOR THE PRODUCTION OF WRAPPERS

This invention concerns improvements in or relating to the production of two-piece wrappers for wrapping articles, such as groups of cigarettes.

Cigarettes are commonly wrapped, before enclosure in a packet, in an interior lining or wrapper of aluminium foil, consisting of a long piece which overlaps a short piece towards the opening end of the packet. In use the short piece of foil is removed from the packet, thus exposing the ends of the cigarettes.

In one type of known packing machine, which includes apparatus for wrapping cigarettes in such wrappers, the long and short pieces are cut from a moving web of foil by a pair of knives rotating about a single axis parallel to the path of the web, an overlap being produced between the pieces by creating a momentary difference in speed between the two pieces. With increases in production speeds it has been found difficult to ensure that the pieces have cut ends which are square (i.e. perpendicular to their sides), and that the amount of overlap is consistent. The present invention sets out to overcome such shortcomings.

According to the invention there is provided apparatus for producing two-piece wrappers for wrapping articles, such as groups of cigarettes, comprising means for feeding a web of wrapper material along a path, a pair of cylindrical cutters spaced along the path, the cutters being rotatable in timed relationship about respective axes transverse to the path, and conveyor means at the end of the path for receiving successive cut wrapper pieces, the arrangement being such that each newly cut end of the web is engaged by the conveyor means prior to the next cutter operating.

Figure 1:
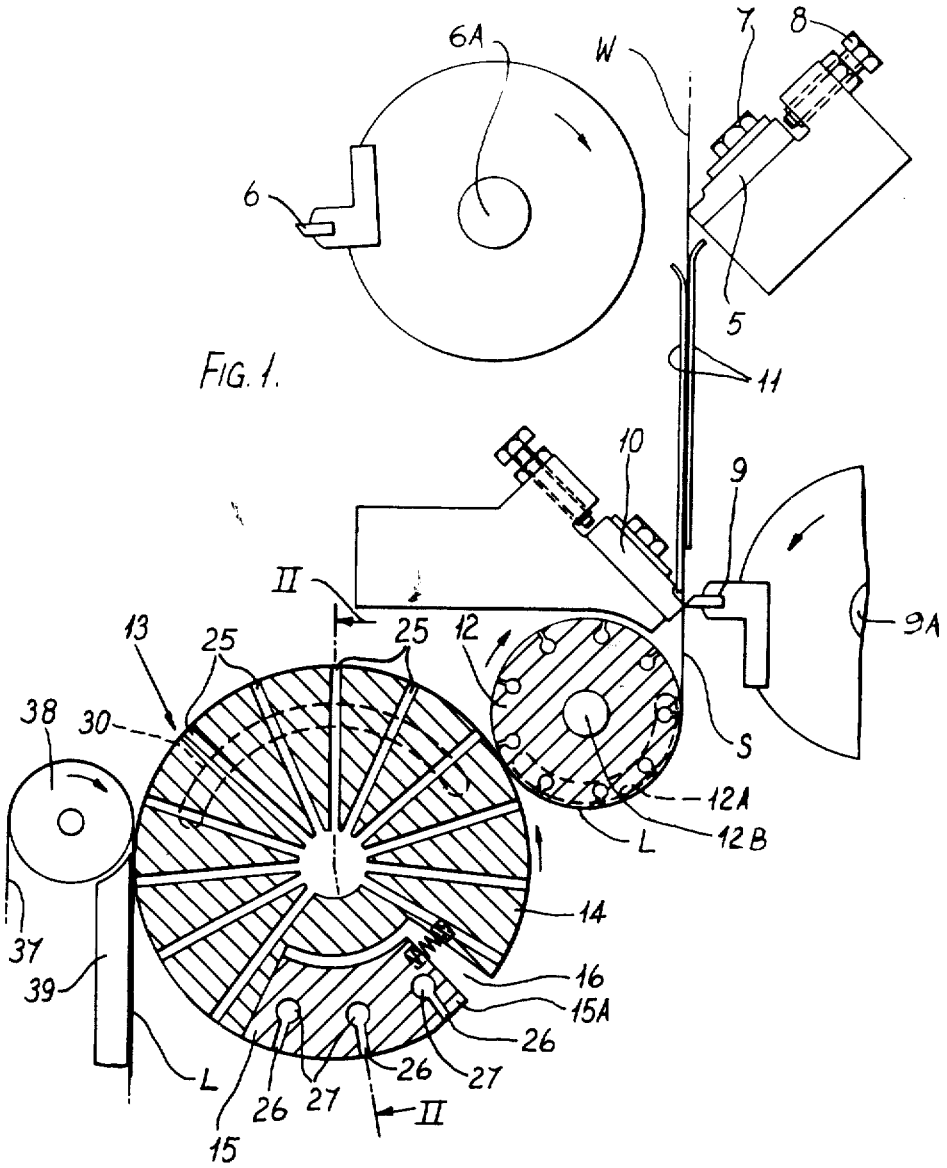
Figure 2:
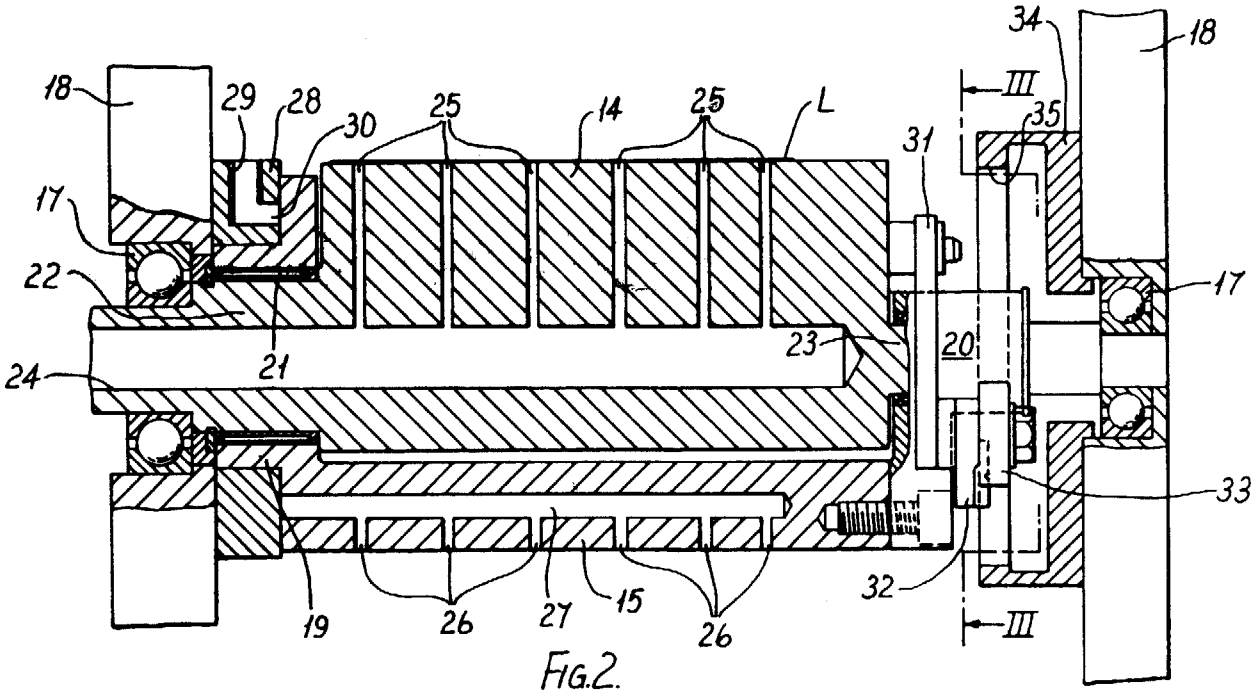
Figure 4:
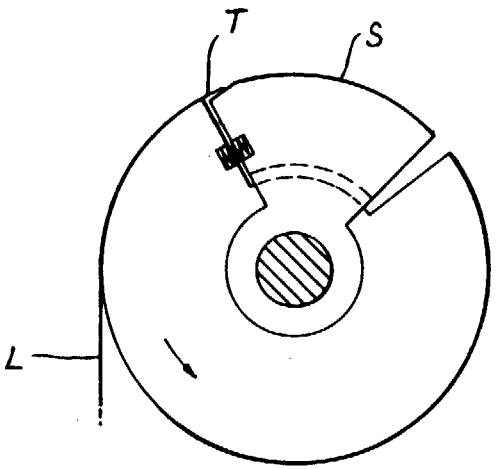
Figure 3:
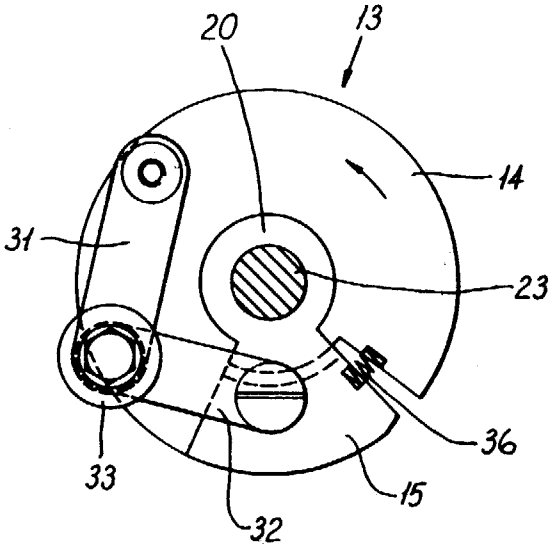

The invention will now be described, by way of example only, with reference to the accompanying drawings in which:

FIG. 1 is an end view, partly in section, of apparatus according to the invention, FIG. 2 is a sectional front view of a suction drum of FIG. 1 taken on the line II—II thereof, FIG. 3 is an end view of the suction drum taken on the line III—III of FIG. 2, and FIG. 4 is a simplified end view similar to FIG. 3 but with the suction drum shown in a different position.

Referring first to FIG. 1 there is shown part of a machine for wrapping bundles of cigarettes (not shown) in a two-piece aluminum foil wrapper. A web of aluminum foil W is fed by known means (not shown) past a fixed blade 5 against which a rotating cylindrical cutter 6 is operable. The position of the fixed blade 5 can be adjusted, after slackening of a clamp 7, by screwing one or more bolts 8 in the appropriate direction. The blade 5 has a tip of high-speed steel welded to it, so that if it is too closely positioned relative to the rotating cutter 6, which has a harder tip made of tungsten carbide, it will be cut by the carbide tip and not fractured. The blade 5 and cutter 6 are so positioned relative to one another that during cutting they meet at an angle of about 20 minutes, thus providing a slight scissor cutting action therebetween and ensuring squarely cut ends.

Below the blade 5 is a further cylindrical cutter 9 similar to the cutter 6, but rotatable in the opposite sense. The cutter 9 operates against a fixed blade 10 positioned below the cutter 6, which is similar to the blade 5 and likewise has provision for adjustment.

Between the blades 5 and 10 extend two guide plates 11 between which the foil W passes.

A suction roller 12, provided with apertures around its circumference and driven by shaft 12B at a peripheral speed corresponding to the speed of the web, is positioned beneath the fixed blade 10. Suction is applied to the apertures at the lower part of the roller 12 through an arcuate port 12A.

The cutters 6 and 9 are driven by shafts 6A and 9A at the same peripheral speed, which is greater than the speed of the web, and are set on their shafts so that they cut alternately.

At the position shown in FIG. 1 the cutter 9 is about to sever a short piece S of foil from the web W. The leading end of the piece S has already engaged the roller 12 and is held thereto by suction, so that during and after severing the piece S becomes held over a progressively increasing length against the lower part of the roller. By the time the cutter 6 is in position to sever a long piece L of foil from the web, the newly cut leading end of the web will likewise have engaged the roller. In this manner long and short pieces of foil are alternately severed from the web and engagingly received by the roller.

From the roller 12 the pieces of foil are transferred to a suction drum 13 whose peripheral speed also corresponds to the web speed. The drum 13 consists of a main body 14 and a sector 15 fitting in the body, a gap 16 being formed at one side of the sector.

Referring now also to FIGS. 2 and 3, the body 14 is rotatably mounted at its ends in bearings 17 in a frame 18, and driven from its left-hand end (FIG. 2). Lugs 19 and 20 are formed at the ends of the sector 15, which are mounted on bearings 21 (only the left-hand bearing being shown) on waisted portions 22 and 23 of the body. The lugs support the sector 15 from the body 14 and allow a small arcuate movement of the sector relative to the body. The sector 15 is preferably made of a light material, so that at high speeds the inertia forces of such arcuate movements are kept to a minimum.

A large axial bore 24, connected to a source of suction, is provided at the center of the body 14, and from it a number of small suction passages 25 radiate to the peripheral surface of the body. The surface of the sector is similarly provided with suction passages 26 emanating from three axial bores 27. A fixed suction ring 28, having a radial inlet 29 connected to a source of suction, extends around the lug 19. The inlet 29 leads into an arcuate port 30 (shown dotted in FIG. 1), the port connecting up with the bores 27 when the sector 15 rotates with the body 14 to the upper position of FIG. 4 (in which the suction drum is shown advanced by about 180° compared with FIGS. 1 and 3).

On the right of the body 14, as viewed in FIG. 2, there is pivotally mounted a link 31, and a further link 32 is pivotally mounted on the sector 15 so that the two links form a connecting toggle. The free ends of the links meet at an obtuse angle and are connected by a pivot which also supports a cam follower roller 33.

Secured to the right-hand side of the frame 18, and coaxial with the body 14, is an annular member 34 having an internal cam 35 on which the roller 33 runs.

The sector 15 is normally held in a rearward position in relation to the counter-clockwise rotation of the whole suction drum 13 (FIG. 3), by one or more compression springs 36 positioned between the leading face of the sector 15 and the body 14. When the roller 33 meets a rise portion of the cam 35, i.e. a portion of the cam of reducing radius, the roller is forced inwards towards the axis of rotation of the drum 13, thus increasing the angle between the links 31, 32. In consequence the sector 15 moves counter-clockwise relative to the body 14 causing the gap 16 to decrease and the springs 36 to be compressed.

To the left of the suction drum 13 (as viewed in FIG. 1) is a suction band 37, which passes around a pulley 38, and to which suction is applied from a duct 39. The band 37 receives the pieces of foil from the suction drum 13 and feeds them to mechanism (not shown) for wrapping bundles of cigarettes in the foil.

In the position shown in FIG. 1 a long piece L of foil has been almost fully transferred from the suction roller 12 to the body 14 of the suction drum 13. When fully transferred, the trailing end T of the piece L extends over the gap 16, as can be seen in FIG. 4. A short piece S is next transferred to the suction surface of the sector 15.

It will be noticed that the leading corner 15A of the sector 15 is slightly chamfered, so that the leading end of the short piece S is nearer the axis of the suction drum 13 than the trailing end T of the preceding long piece L. As soon as the trailing end of the short piece S has been transferred to the sector, the roller 33 meets the rise portion of the cam 35 which causes the sector to start moving the short piece S towards the long piece L, bringing the leading end of the short piece underneath the trailing end T (FIG. 4). It should also be noted that at this moment the long piece L of the next pair of wrapper pieces will start to be transferred to the main body 14.

By the time the trailing end T has reached the suction band 37 the gap 16 will have closed, and the overlap between the two pieces L and S will have been completed. Suction to the passages 26 of the sector will then be cut off as the short piece S is transferred to the band 37. After the sector has left the band 37, the roller 33 reaches a falling portion of the cam (i.e. where the radius is increasing) allowing the springs 36 to return the sector to the position shown in FIGS. 1 and 3.

Suction may be applied continuously to the passages 25 of the main body 14, in which case it is necessary for a greater suction to be applied to the band 37 so as to remove the foil from the surface of the body 14. Alternatively a stationary valve member could be positioned within the bore 24 to cut off suction to the passages 25 upon reaching the band 37.

If it is required to change the length of the long or short piece of foil it is necessary to replace the suction drum 13 with another drum of larger or smaller diameter, as the case may be: the circumference of the drum 13 must correspond in each case with the sum of the lengths of the long and short pieces. As the position of the suction band 37 is fixed, a larger drum 13 necessitates a suitably smaller suction roller 12, and vice versa.

If, for example, the length of the short piece S is to remain unchanged and that of the long piece L is to be reduced, a smaller suction drum will be required (i.e. one in which the length of the arc of the body 14 is correspondingly smaller) together with a suitably larger suction roller 12. Further, if the output of the wrapping machine remains unaltered, the speed of the cutters 6 and 9 will not be changed; however, the speed of the foil web must be reduced in proportion to the reduction in the total length of the long and short pieces of foil. If, then, the relative angular positions of the cutters 6 and 9 were unaltered, this would result in a shorter piece S being severed by the cutter 9. The angular position of the cutter 9 must therefore be correspondingly retarded relative to the cutter 6, so as to produce a short piece S of unaltered length.

We claim:

1. Apparatus for producing two-piece wrappers wherein said pieces are of unequal length, for wrapping articles such as groups of cigarettes, said apparatus comprising:

(a) means for continuously feeding a web of wrapper material along a single path, (b) a pair of cutters spaced along said path, (c) conveyor means along said path spaced downstream from said cutters, and movable at the speed at which said feeding means feeds said web, for sequentially receiving and conveying cut wrapper pieces, and (d) means for operating said cutters in timed relationship with the speed of said conveyor means such that said cutters alternately cut said web into pieces of unequal length and each newly cut end of said web is engaged by said conveyor means prior to the next cutter cutting the next piece from said web, (e) said conveyor means comprising a suction roller having means for applying suction thereto from the point at which said newly cut end of the web is engaged by said roller.

2. Apparatus according to claim 1 in which the cylindrical cutters are disposed at opposite sides of the path of the web.

3. Apparatus according to claim 1 in which each cylindrical cutter operates against a fixed blade which is adjustably mounted relative to the cutter.

4. Apparatus according to claim 3 in which each blade comprises a tip made of a material, such as high-speed steel, which is relatively softer than the material of the respective cutter.

5. Apparatus according to claim 1 wherein said cutters are cylindrical cutters mounted for rotation about respective axes transverse to said path and said cutter operating means is adapted to rotate said cutters.

6. Apparatus for producing two-piece wrappers for wrapping articles, such as groups of cigarettes, comprising means for feeding a web of wrapper material along a path, a pair of cylindrical cutters spaced along the path, the cutters being rotatable in timed relationship about respective axes transverse to the path, conveyor means at the end of the path for receiving successive cut wrapper pieces, the arrangement being such that each newly cut end of the web is engaged by the conveyor means prior to the next cutter operating, and a rotatable suction drum for receiving the cut wrapper pieces from the conveyor means, the drum comprising a main body for receiving one wrapper piece of a pair, a sector mounted on the body for limited arcuate movement relative to the body and for receiving the other wrapper piece of the pair, and actuating means to move the sector relative to the main body to bring each pair of wrapper pieces in turn into overlapping relationship.

7. Apparatus according to claim 6 in which the actuating means comprises a pair of links forming a toggle and connected between the sector and the main body, and a cam operable on the links to vary the distance between their ends.

8. Apparatus for producing two-piece wrappers for wrapping articles, such as groups of cigarettes, comprising (a) means for feeding a web of wrapper material along a path, (b) a pair of cutters spaced along said path, (c) conveyor means along said path spaced downstream from said cutters for receiving and conveying successive cut pieces, and (d) overlapping means along said path downstream from said conveyor means for receiving said successive cut pieces from said conveyor means, (e) said overlapping means comprising a main body mounted for movement along said path for receiving one piece of a pair of pieces, a second body mounted for movement along said path and for limited movement relative to said main body and for receiving the other piece of said pair, and actuating means to move said second body relative to said main body to bring each pair of pieces in turn into overlapping relationship to form a two-piece wrapper.

9. Apparatus according to claim 8 wherein said overlapping means comprises a rotatably mounted suction drum, said drum comprising a main body for receiving one piece of a pair of pieces, a sector mounted on said main body for limited arcuate movement relative to said body and for receiving the other piece of said pair of actuating means to move said sector relative to said main body to bring said pair of pieces in turn into overlapping relationship to form a two-piece wrapper.

10. Apparatus according to claim 9 wherein said cutters are cylindrical cutters mounted for rotation about respective axes transverse to said path.

* * * * *